US005318090A

United States Patent [19]

Chen

[11] Patent Number: 5,318,090

[45] Date of Patent: Jun. 7, 1994

[54] ROLLER ASSEMBLY FOR VENETIAN BLIND

[76] Inventor: Cheng-Hsiung Chen, No. 228, Sec. 2, Chung-Te Rd., Taichung City, Taiwan

[21] Appl. No.: 60,278

[22] Filed: May 11, 1993

[51] Int. Cl.[5] ..... E06B 9/30

[52] U.S. Cl. ..... 160/171

[58] Field of Search ..... 160/171, 170, 168.1, 160/176.1, 177, 178.1, 166.1, 173, 243

[56] References Cited

U.S. PATENT DOCUMENTS

| | | | |
|---|---|---|---|
| 3,141,497 | 7/1964 | Griesser | 160/170 |
| 4,955,421 | 9/1990 | Torti | 160/170 X |
| 5,070,927 | 12/1991 | Chen | 160/171 X |
| 5,103,888 | 4/1992 | Nakamura | 160/171 |
| 5,123,472 | 6/1992 | Nagashima et al. | 160/170 |

*Primary Examiner*—David M. Purol
*Attorney, Agent, or Firm*—Ladas & Parry

[57] ABSTRACT

A roller assembly for a Venetian blind includes a rotating rod which has a rectangular axial hole formed therethrough. A portion of a pull cord is wound on the rotating rod so as to move slats vertically. A movable member of a rectangular cross-section is engaged in the rotating rod and has a threaded axial hole formed therethrough. An elongated driving member has a shaft section of a rectangular cross-section engaged within the rectangular axial hole of the rotating rod, a driven wheel section secured to the shaft section, and a circular axial hole formed through the shaft section and the driven wheel section. A lift cord is disposed on the driven wheel section. A guide unit is mounted securely on a window frame and includes a threaded horizontal rod extending through the circular axial hole of the driving member and through the threaded hole of the movable member. Accordingly, when the lift cord is pulled, the driving member rotates the rotating rod so as to move the movable member on the threaded horizontal rod of the guide unit, thereby rotating and moving the rotating rod on the guide unit.

3 Claims, 7 Drawing Sheets

ROLLER ASSEMBLY FOR VENETIAN BLIND

BACKGROUND OF THE INVENTION

1. Field of the Invention

This invention relates to a roller assembly for a Venetian blind, more particularly to a roller assembly which has a rotating rod unit and an elongated driving member that rotates the rotating rod unit so as to raise or lower the slats.

2. Description of the Related Art

This invention is an improvement of a roller assembly for a Venetian blind which was disclosed in U.S. Pat. No. 5,070,927 by applicant. The roller assembly includes a driving means in which a thin straight shaft can be rotated so as to raise or lower the slats. Because the shaft is too thin, the shaft is easily deformed when the roller assembly is used for a long time, thereby causing difficulty in activating the slats.

SUMMARY OF THE INVENTION

The main object of this invention is to provide a durable roller assembly for a Venetian blind which can support heavier slats thereon.

According to this invention, a roller assembly for a Venetian blind has a rotating rod, a movable member, an elongated driving member, a lift cord and a guide unit. The rotating rod has a rectangular axial hole formed therethrough and is used to wind a portion of a pull cord thereon so as to move the slats vertically. The movable member is fixed in an intermediate portion of the rotating rod and has a threaded axial hole formed therethrough. The elongated driving member includes a shaft section of a rectangular cross-section engaged within an end portion of the rectangular axial hole of the rotating rod and spaced apart from the movable member at a predetermined distance, a driven wheel section connected securely to an end of the shaft section, and a circular axial hole formed through the shaft section and the driven wheel section. The lift cord has a portion disposed around the upper surface of the driven wheel section of the driving member. The guide unit is mounted securely on a window frame and includes a threaded horizontal rod extending through the circular axial hole of the driving member and through the threaded hole of the movable member. Accordingly, when the lift cord is pulled, the driving member rotates the rotating rod so as to move the movable member on the threaded horizontal rod of the guide unit, thereby rotating and moving the rotating rod on the guide unit. Rotation of the rotating rod enables the portion of the pull cord to wind on or unwind from the rotating rod.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENT

Figure 1:
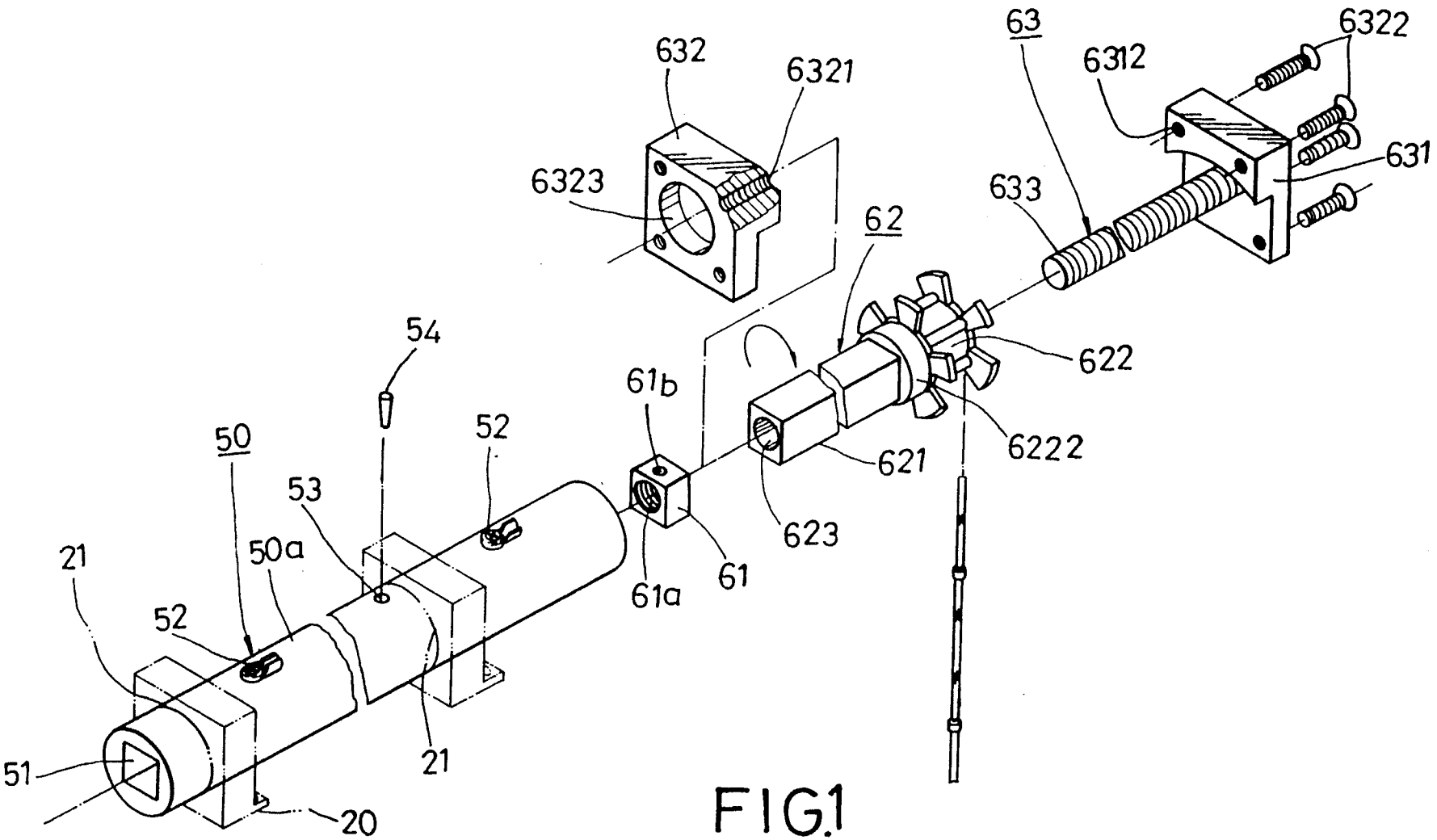
FIG. 1 is an exploded view showing a roller assembly for a Venetian blind according to this invention.
Figure 2:
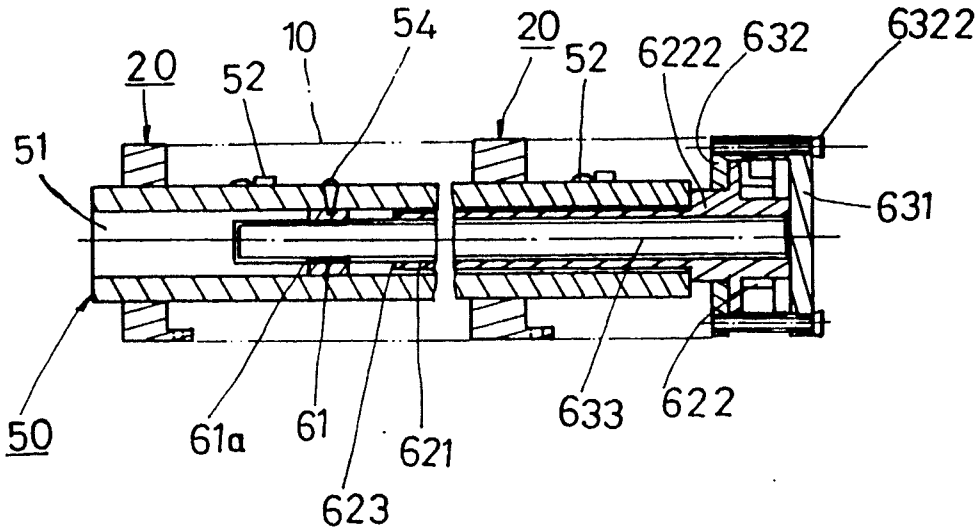
FIG. 2 is a sectional view of the roller assembly of this invention.
Figure 5:
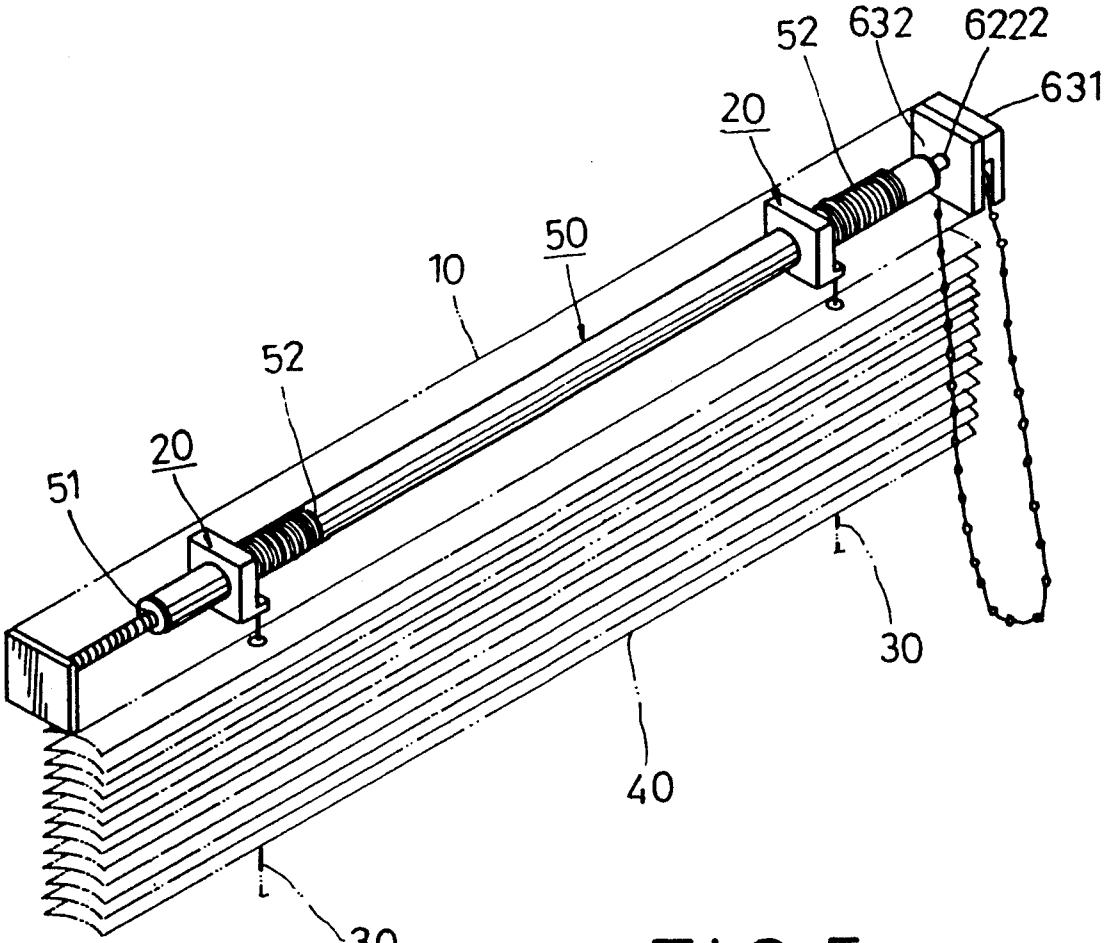
FIG. 5 is a perspective view of the roller assembly for the Venetian blind wherein two pull cords are wound on a rotating rod according to this invention.

Referring to FIGS. 1, 2, and 5, a roller assembly of this invention is used for a Venetian blind and includes an elongated rectangular hollow casing (10) (shown in phantom lines in FIGS. 2 and 5) mounted securely on a window frame, a row of cradles (20) fixed in the hollow casing (10), two pull cords (30), and a plurality of slats (40) (shown in phantom lines in FIG. 5). Each of the cradles (20) has a positioning hole (21) formed therethrough.

The roller assembly of this invention further includes a rotating rod unit (50), a movable member (61), an elongated driving member (62) and a guide unit (63).

The rotating rod unit (50) is journalled within the positioning holes (21) of the cradles (20) and includes a rotating rod (50*a*) with a rectangular axial hole (51) formed therethrough. A lock member (52) is connected securely to the outer surface of the rotating rod (50*a*). A pin hole (53) is formed through a wall of the rotating rod (50*a*). The pull cord (30) has an end fastened to the lock member (52) of the rotating rod (50*a*) so that a portion of the pull cord (30) is wound on the rotating rod (50*a*) so as to move the slats (40) vertically.

The movable member (61) is fixed in an intermediate portion of the rotating rod (50*a*) and has a threaded axial hole (61*a*) formed through the movable member (61) and a lock hole (61*b*) formed through a wall of the movable member (61). The rotating rod unit (50) further has a pin (54) extending through the pin hole (53) and the lock hole (61*b*) so as to fasten the movable member (61) to the rotating rod (50*a*).

The elongated driving member (62) has a circular axial hole (623) formed therethrough, a shaft section (621) of a rectangular cross-section which is engaged within an end portion of the rectangular axial hole (51) of the rotating rod (50*a*) and which is spaced apart from the movable member (61) at a predetermined distance, and a driven wheel section (622) having a circular projection section (6222) which interconnects the driven wheel portion (622) and the shaft portion (621). The circular axial hole (623) is formed through the shaft section (621) and the driven wheel section (622). The driving member (62) further includes a lift cord (623) which has a portion disposed around the upper portion of the driven wheel section (622) of the driving member (62). Referring to FIG. 5, the lift cord (623) is capable of being pulled to move in a direction so as to rotate the driven wheel section (622) of the driving member (62) clockwise and is capable of being pulled to move in the opposite direction so as to rotate the driven wheel section (622) of the driving member (62) counterclockwise.

The guide unit (63) includes a rectangular connecting portion (631) which has four holes (6312) (only three holes are shown in FIG. 1) formed through four corners thereof and which is mounted securely on an end of the hollow casing (10), and a threaded horizontal rod (633) having a first end which is connected securely to the connecting portion (631), and a second end which extends through the circular axial hole (623) of the driving member (62) so as to engage the threaded hole (61*a*) of the movable member (61). The guide unit (63) further includes a sleeve portion (632). The sleeve portion (632) has four blind threaded holes (6321) (only one is shown in FIG. 1) aligned with the holes (6312) of the connecting portion (631), and a sleeve hole (6323) formed therethrough and engaged with the projection section (6222) of the driven wheel section (622) of the driving member (62). Two bolts (6322) extend through the holes (6312) of the connecting portion (631) to engage the blind holes (6321) of the sleeve portion (632) so as to position the driven wheel section (622) of the driving member (62) between the sleeve portion (632) and the connecting portion (631) of the guide unit (63). Accordingly, the driving member (62) is disposed on the guide unit (63) in such a manner that the driving member (62) can rotate about the threaded horizontal rod (633) of the guide unit (63) and that the driving member (62) cannot move relative to the guide unit (63).

Figure 6:
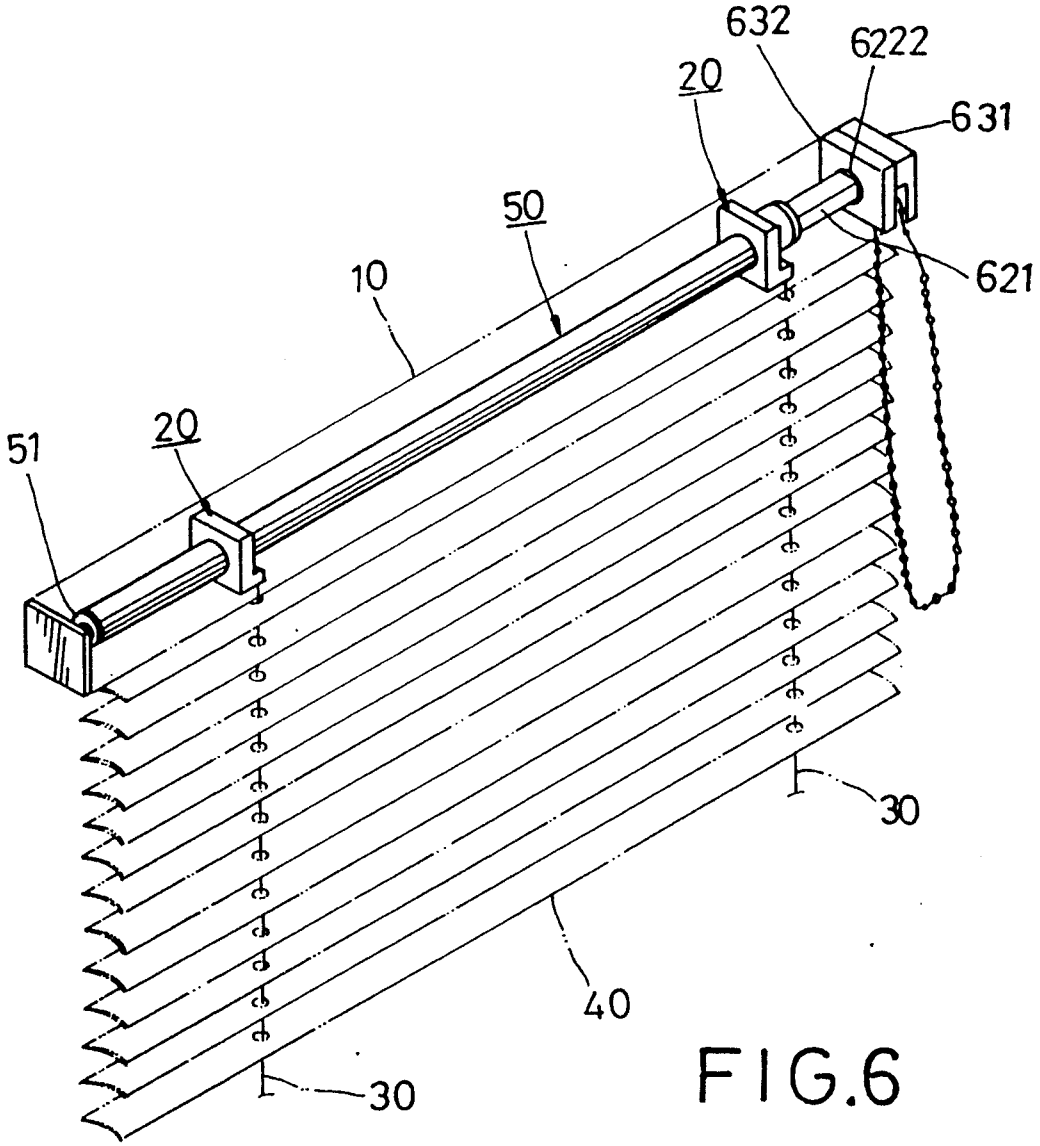
FIG. 6 is a perspective view of the roller assembly for the Venetian blind wherein the pull cords are unwound from the rotating rod according to this invention.

When the lift cord is pulled in a known manner, the driving member (62) rotates the rotating rod (50*a*) so as to move the movable member (61) on the threaded horizontal rod (633) of the guide unit (63), thereby rotating and moving the rotating rod (50*a*) on the guide unit (63). The rotation of the rotating rod (50*a*) enables the portion of the pull cord (30) to wind on or unwind from the rotating rod (50*a*). As a result, the slats (40) can be selectively located on the position of FIG. 5 or 6.

Figure 3:
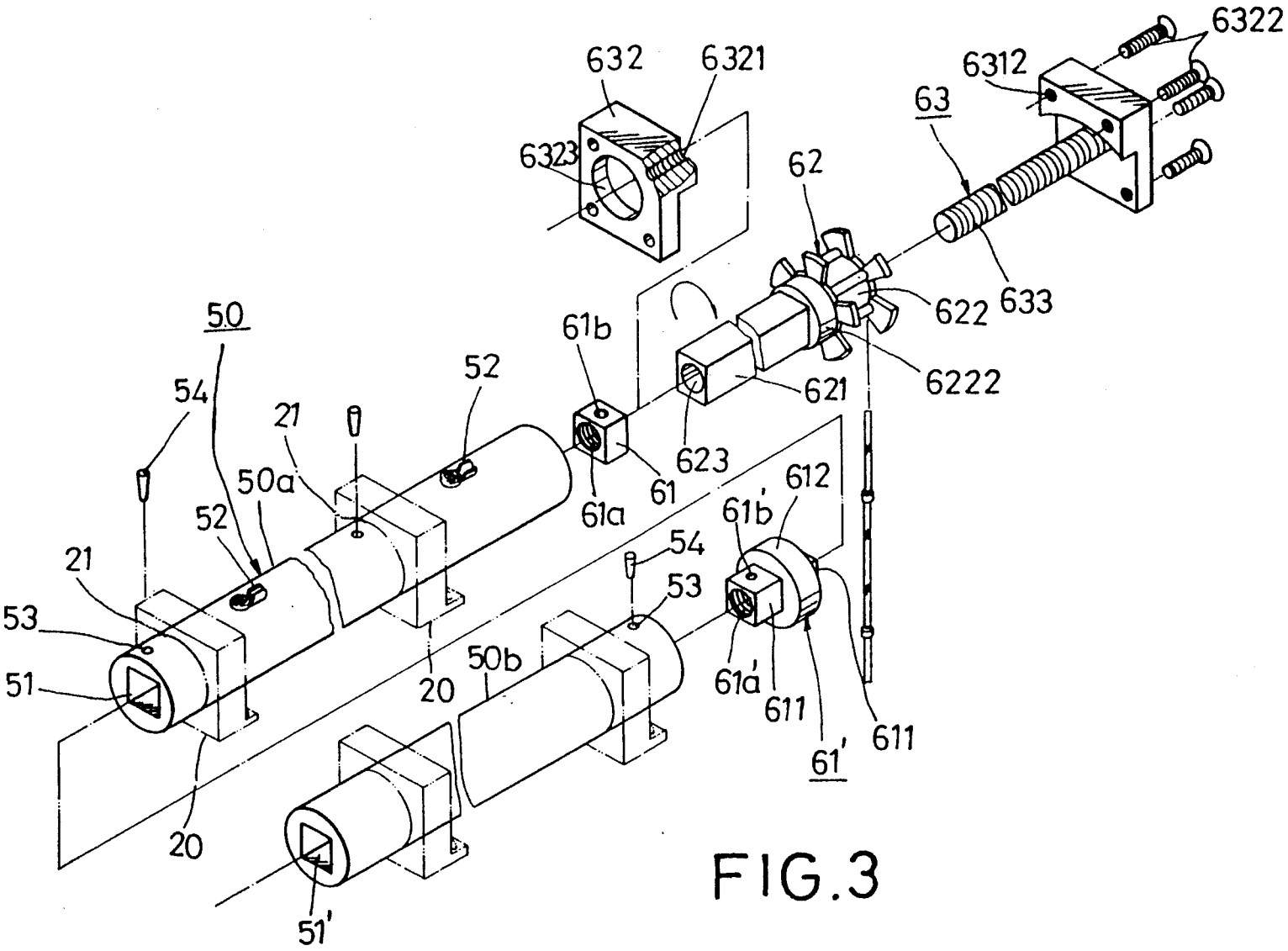
FIG. 3 is an exploded view showing a modified form of the roller assembly according to this invention.
Figure 4:
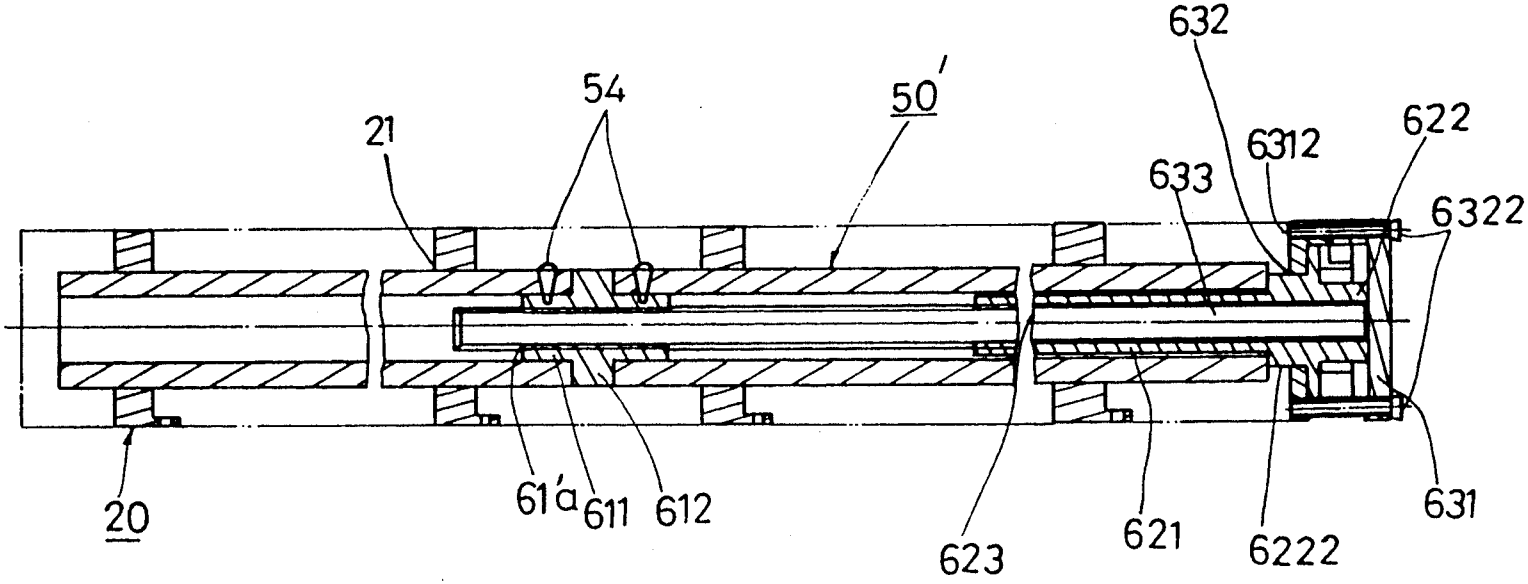
FIG. 4 is a sectional view of the modified form of the roller assembly in accordance with this invention.
Figure 7:
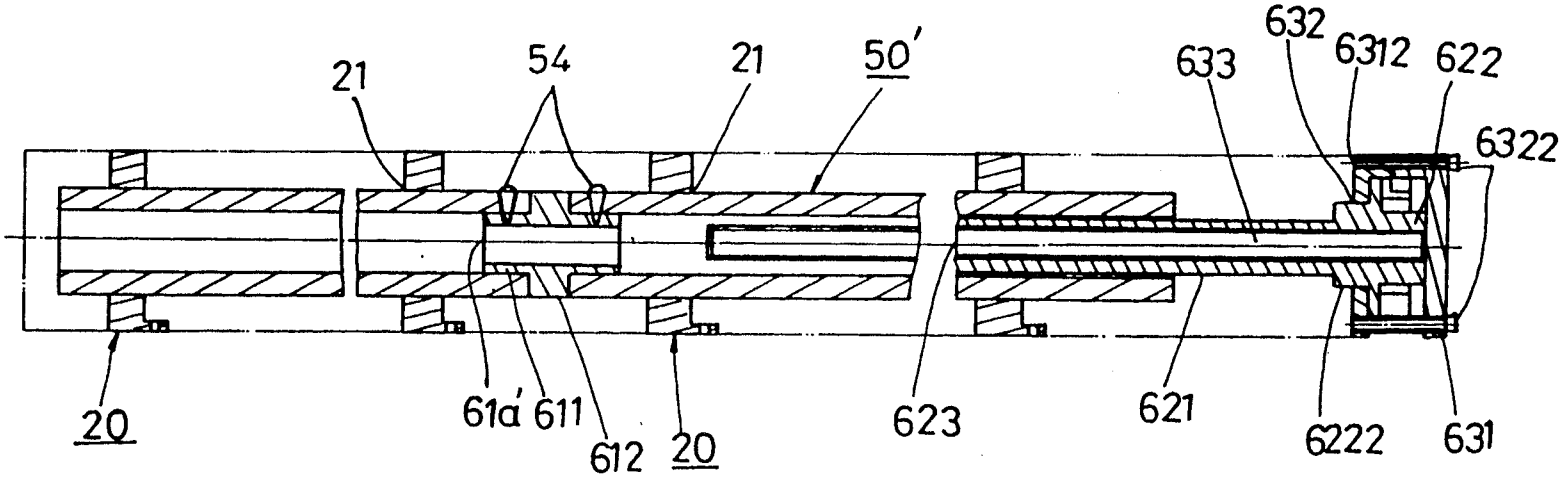
FIG. 7 is a sectional view of the modified form illustrating how the rotating rod unit moves on the guide unit in accordance with this invention.

An alternative form of the rotating rod unit is shown in FIGS. 3, 4 and 7. The rotating rod unit (50') further includes an extension rod (50*b*) with a rectangular axial hole (51') formed therethrough, and an elongated connector (61'). The connector (61') has a threaded axial hole (61*a*') formed therethrough, a cylindrical middle portion (612), and two connecting end portions (611) connected securely to two opposite ends of the middle portion (612). Each of the rotating rod (50*a*) and the extension rod (50*b*) has a pin hole (53) formed through the respective wall thereof. The connecting end portions (611) of the connector (61') are of a rectangular cross-section. One of the connecting end portions (611) of the connector (61') is engaged within the rectangular axial hole (51) of the rotating rod (50*a*), while the other of the connecting end portions (611) of the connector (61') is engaged within the rectangular axial hole (51') of the extension rod (50*b*). Each of the connecting end portions (611) of the connector (61') has a lock hole (61*b*') formed through the wall thereof. The rotating rod unit (50') further includes two lock pins (54), each of which extends through one of the pin holes (53) and one of the lock holes (61*b*') so as to fasten the connector (61') to the rotating rod (50*a*) and the extension rod (50*b*). Accordingly, the overall length of the rotating rod unit (50') is increased.

With this invention thus explained, it is apparent that numerous modifications and variations can be made without departing from the scope and spirit of this invention. It is therefore intended that this invention be limited only as indicated in the appended claims.

I claim:

1. A roller assembly for a Venetian blind, comprising:

a row of cradles adapted to be mounted securely on a window frame, each of said cradles having a positioning hole formed therethrough;

a rotating rod unit, journalled within said positioning holes of said cradles, including a rotating rod having a rectangular axial hole formed therethrough, said retaining rod unit being adapted to wind a portion of a pull cord thereon which is adapted to move slats vertically;

a movable member which is fixed in an intermediate portion of said rotating rod and which has a threaded axial hole formed therethrough;

an elongated driving member having a circular axial hole formed therethrough, a shaft section of a rectangular cross-section engaged within an end portion of said rectangular axial hole of said rotating rod and spaced apart from said movable member at a predetermined distance, and a driven wheel section having a central portion connected securely to an end of said shaft section, said circular axial hole being formed through said shaft section and said driven wheel section;

a lift cord having a portion disposed around an upper portion of said driven wheel section of said driving member, said lift cord being capable of being pulled to move in a direction so as to rotate said driven wheel section of said driving member clockwise, said lift cord being capable of being pulled to move in the opposite direction so as to rotate said driven wheel section of said driving member counterclockwise; and a guide unit which is mounted securely on said window frame and which includes a threaded horizontal rod extending through said circular axial hole of said driving member and through said threaded hole of said movable member, said driving member being disposed on said guide unit in such a manner that said driving member can rotate about said threaded horizontal rod of said guide unit and that said driving member cannot move relative to said guide unit;

whereby, when said lift cord is pulled, said driving member rotates said rotating rod so as to move said movable member on said threaded horizontal rod of said guide unit, thereby rotating and moving said rotating rod on said guide unit, rotation of said rotating rod enabling-the portion of said pull cord to wind on or unwind from said rotating rod.

2. A roller assembly as claimed in claim 1, wherein said rotating rod unit further includes an extension rod having a rectangular axial hole formed therethrough, and an elongated connector having a threaded axial hole formed therethrough, a cylindrical middle portion, and two connecting end portions connected securely to two opposite ends of said middle portion, one of said connecting end portions of said connector being connected removably to an end of said rotating rod, the other of said connecting end portions being connected removably to an end of said extension rod, said threaded horizontal rod of said guide unit extending through said threaded axial hole of said connector, whereby, overall length of said rotating rod unit is increased.

3. A roller assembly as claimed in claim 2, wherein each of said rotating rod and said extension rod has a pin hole formed through a wall thereof, said connecting end portions of said connector being rectangular in cross-section, one of said connecting end portions of said connector being engaged within said rectangular axial hole of said rotating rod, the other of said connecting end portions of said connector being engaged within said rectangular axial hole of said extension rod, each of said connecting end portions of said connector having a lock hole formed through a wall thereof, said rotating rod unit further including two lock pins each of which extends through one of said pin holes and one of said lock holes so as to fasten said connector to said rotating rod and said extension rod.

* * * * *